US009767734B2

(12) United States Patent
Jun et al.

(10) Patent No.: US 9,767,734 B2
(45) Date of Patent: Sep. 19, 2017

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Bong-Ju Jun, Seongnam-si (KR); Won-Chang Chung, Hwaseong-si (KR); Kwang-Suk Shin, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 103 days.

(21) Appl. No.: 14/720,477

(22) Filed: May 22, 2015

(65) Prior Publication Data

US 2016/0210903 A1 Jul. 21, 2016

(30) Foreign Application Priority Data

Jan. 20, 2015 (KR) ..... 10-2015-0009268

(51) Int. Cl.
*G09G 3/20* (2006.01)
*G09G 3/32* (2016.01)
(Continued)

(52) U.S. Cl.
CPC ..... *G09G 3/3266* (2013.01); *G09G 3/20* (2013.01); *G09G 3/3208* (2013.01);
(Continued)

(58) Field of Classification Search
CPC ..... G09G 3/20; G09G 3/3208; G09G 3/3266; G09G 3/3275; G09G 2300/0819;
(Continued)

(56) References Cited

U.S. PATENT DOCUMENTS 6,414,661 B1 * 7/2002 Shen ..... G09G 3/3208 345/46
6,710,548 B2 * 3/2004 Kimura ..... G09G 3/3233 315/169.3

(Continued)

FOREIGN PATENT DOCUMENTS

KR 10-2006-0025782 A 3/2006
KR 10-2012-0094736 A 8/2012

(Continued)

OTHER PUBLICATIONS

EPO Office action dated Jun. 10, 2016, for corresponding European Patent application 15181522.2, (9 pages).

(Continued)

*Primary Examiner* — Michael J Eurice
(74) *Attorney, Agent, or Firm* — Lewis Roca Rothgerber Christie LLP

(57) ABSTRACT

An display device includes a display panel including a plurality of pixels; a scan driver configured to provide scan signals to the pixels; a data driver configured to provide data signals to the pixels; a look-up table (LUT), wherein an efficiency curve indicating a relationship between an accumulated driving time and an efficiency value is stored in the LUT; a lifespan register, wherein an efficiency changing region for deriving the efficiency value of each of the pixels from the LUT is stored in the lifespan register and the lifespan register is configured to accumulatively store deterioration data of the pixels; and a controller configured to derive the accumulated driving time from the lifespan register, to update the efficiency changing region and the LUT based on the accumulated driving time, and to convert input image data into output image data using the efficiency changing region and the LUT.

22 Claims, 9 Drawing Sheets

(51) Int. Cl.
*G09G 3/3266* (2016.01)
*G09G 3/3275* (2016.01)
*G09G 3/3208* (2016.01)

(52) U.S. Cl.
CPC ... *G09G 3/3275* (2013.01); *G09G 2300/0819* (2013.01); *G09G 2310/0272* (2013.01); *G09G 2310/067* (2013.01); *G09G 2320/0233* (2013.01); *G09G 2320/0295* (2013.01); *G09G 2320/04* (2013.01); *G09G 2320/043* (2013.01); *G09G 2320/048* (2013.01); *G09G 2360/16* (2013.01)

(58) Field of Classification Search
CPC ..... G09G 2320/04; G09G 2320/043; G09G 2320/048; G09G 2320/0233; G09G 2360/16
See application file for complete search history.

(56) References Cited

U.S. PATENT DOCUMENTS 7,167,169 B2 * 1/2007 Libsch ..... G09G 3/3233 345/211
7,227,519 B1 * 6/2007 Kawase ..... G09G 3/2081 345/77
2003/0063053 A1 * 4/2003 Yamazaki ..... G09G 3/3241 345/82
2003/0169219 A1 * 9/2003 LeChevalier ..... G09G 3/3216 345/84
2004/0150594 A1 * 8/2004 Koyama ..... G09G 3/3216 345/82
2004/0174388 A1 * 9/2004 Sempel ..... G09G 3/20 345/691
2005/0007392 A1 * 1/2005 Kasai ..... G09G 3/2014 345/690
2005/0030267 A1 * 2/2005 Tanghe ..... G09G 3/3216 345/82
2006/0007206 A1 * 1/2006 Reddy ..... G06F 3/03542 345/204
2006/0071886 A1 * 4/2006 Johnson ..... G09G 3/3216 345/77
2006/0077136 A1 * 4/2006 Cok ..... G09G 3/3216 345/76
2006/0227084 A1 * 10/2006 Cok ..... H01L 27/32 345/82
2008/0088648 A1 * 4/2008 Nathan ..... G09G 3/3233 345/690
2008/0204384 A1 * 8/2008 Lee ..... G09G 3/3233 345/83
2008/0204438 A1 * 8/2008 Song ..... G09G 3/3225 345/207
2008/0224966 A1 * 9/2008 Cok ..... G09G 3/32 345/82
2008/0231557 A1 * 9/2008 Naugler ..... G09G 3/3225 345/76
2008/0252650 A1 * 10/2008 Ryu ..... G09G 3/2022 345/545
2009/0027377 A1 * 1/2009 Kwon ..... G09G 3/3233 345/214
2009/0184901 A1 * 7/2009 Kwon ..... G09G 3/3233 345/77
2009/0184903 A1 * 7/2009 Kwon ..... G09G 3/3225 345/80
2010/0164999 A1 7/2010 Chan
2011/0141160 A1 * 6/2011 Nathan ..... G09G 3/3233 345/690
2012/0139882 A1 * 6/2012 Kim ..... G09G 5/008 345/204
2012/0154682 A1 * 6/2012 Yamashita ..... G09G 3/3233 348/649
2012/0287173 A1 * 11/2012 Guttag ..... G09G 3/34 345/690
2013/0278578 A1 * 10/2013 Vetsuypens ..... G09G 3/20 345/207
2015/0279324 A1 * 10/2015 Ohta ..... G09G 3/3283 345/690

FOREIGN PATENT DOCUMENTS

KR 10-2014-0056799 A 5/2014
KR 10-2015-0021370 A 3/2015
WO WO 2008/116009 A1 9/2008

OTHER PUBLICATIONS

EPO Office Action dated May 31, 2017, for corresponding European Patent Application No. 15181522.2 (17 pages).

* cited by examiner

ORGANIC LIGHT EMITTING DISPLAY DEVICE AND METHOD OF DRIVING THE SAME

CROSS REFERENCE TO RELATED APPLICATION

This application claims priority to and the benefit of Korean patent Application No. 10-2015-0009268 filed on Jan. 20, 2015, the disclosure of which is hereby incorporated by reference herein in its entirety.

BACKGROUND

1. Field

Example embodiments of the present invention relate to an organic light emitting display device and a method of driving the organic light emitting display device.

2. Description of the Related Art

An organic light emitting diode (OLED) includes an organic layer between two electrodes, namely, an anode and a cathode. Positive holes from the anode are combined with electrons from the cathode in the organic layer between the anode and the cathode to emit light. The OLED has a variety of characteristics such as a wide viewing angle, a rapid response speed, relatively thin thickness, and low power consumption.

Generally, a pixel having the OLED may deteriorate over time according to the driving time and amount of the driving data. When a pixel deteriorates, the luminance of the pixel may decrease. Therefore, the display quality of a display device may degrade over time due to differences in the degree of deterioration between the pixels.

Various methods of compensating the deterioration of pixels in an OLED display device have been developed to prevent the luminance decrease and display quality degradation. However, the methods of compensating the deterioration of the pixel are limited in resources such as capacity of a register, memory capacity of a look-up table, etc. Therefore, the methods of compensating the deterioration data have some problems such as an incorrect compensation in the beginning period of deterioration, a limited life guaranteed time, etc.

SUMMARY

Example embodiments provide an organic light emitting display device capable of correctly compensating deterioration of pixels and extending a lifespan of a display device.

Example embodiments provide a method of driving the organic light emitting display device.

According to some example embodiments, an organic light emitting display device includes: a display panel including a plurality of pixels; a scan driver configured to provide scan signals to the pixels; a data driver configured to provide data signals to the pixels; a look-up table (LUT), wherein an efficiency curve indicating a relationship between an accumulated driving time and an efficiency value is stored in the LUT; a lifespan register, wherein an efficiency changing region for deriving the efficiency value of each of the pixels from the LUT is stored in the lifespan register and the lifespan register is configured to accumulatively store deterioration data of the pixels; and a controller configured to derive the accumulated driving time from the lifespan register, to update the efficiency changing region and the LUT based on the accumulated driving time, to convert input image data into output image data using the efficiency changing region and the LUT, and to provide control signals corresponding to the output image data to the scan driver and the data driver.

The controller may include: a deterioration data controller configured to accumulatively store the deterioration data in the lifespan register based on the input image data; an update signal generator configured to generate an update signal based on the accumulated driving time; a compensation criterion updater configured to update the efficiency changing region and the LUT in response to the update signal such that an efficiency changing period increases as the accumulated driving time increases; an efficiency value deriver configured to derive the efficiency value using the efficiency changing region and the LUT; and a deterioration compensator configured to convert the input image data into the output image data using the efficiency value.

The update signal generator may be configured to generate the update signal when a value of a monitoring region included in the lifespan register is changed.

A size of the monitoring region may be one bit, and the monitoring region may be shifted by one bit when the value of the monitoring region is changed.

A size of the monitoring region may be larger than one bit.

The compensation criterion updater may shift the efficiency changing region by one bit in response to the update signal.

The compensation criterion updater may be configured to load the efficiency curve corresponding to the efficiency changing region from a non-volatile memory device into the LUT in response to the update signal.

The controller may further include: an efficiency curve adjuster configured to scale the efficiency curve corresponding to the efficiency changing region, and the compensation criterion updater may be configured to update the LUT using the scaled efficiency curve in response to the update signal.

The efficiency curve adjuster may be configured to scale the efficiency curve to approximately double the efficiency changing period in response to the update signal.

The compensation criterion updater may be included in a micro control unit (MCU).

The efficiency value deriver may be configured to derive the efficiency value from the LUT using a value of the efficiency changing region as an index of the LUT.

The deterioration compensator may be configured to derive compensation weight for each of the pixels using the efficiency value, and to generate the output image data by multiplying the input image data by the compensation weight.

The deterioration data controller may be configured to periodically read the deterioration data from the lifespan register, and to store the deterioration data in a non-volatile memory device.

The deterioration data controller may be configured to read the deterioration data from the lifespan register, and to store the deterioration data in a non-volatile memory device at a predetermined time.

The deterioration data for each of the pixels may be stored in the lifespan register.

The deterioration data for each pixel block among a plurality of pixel blocks may be stored in the lifespan register.

According to some example embodiments, in a method of driving an organic light emitting display device, the method includes: accumulatively storing deterioration data of pixels in a lifespan register based on input image data; deriving an accumulated driving time of the pixels from the lifespan register; generating an update signal based on the accumulated driving time; updating an efficiency changing region in the lifespan register and a look-up table (LUT) in response to the update signal such that an efficiency changing period increases as the accumulated driving time increases, an efficiency curve indicating a relation between the accumulated driving time, and an efficiency value stored in the LUT; deriving the efficiency value of each of the pixels from the LUT using a value of the efficiency changing region as an index of the LUT; converting the input image data into output image data using the efficiency value; and displaying an image using the output image data.

The update signal may be generated when a value of a monitoring region in the lifespan register is changed.

The efficiency changing region may be shifted by one bit in response to the update signal.

The efficiency curve corresponding to the efficiency changing region may be loaded from a non-volatile memory device into the LUT in response to the update signal.

The efficiency curve may be scaled in response to the update signal to update the LUT.

The efficiency curve may be scaled to approximately double the efficiency changing period in response to the update signal.

An organic light emitting display device according to example embodiments updates an efficiency changing region and a LUT based on an accumulated driving time. Therefore, the organic light emitting display device compensates (e.g., correctly compensates) deterioration of pixels, especially in the beginning period of deterioration. The organic light emitting display device secures a life guaranteed time indicating a time capable of compensating deterioration of the pixels using the continuously updated deterioration data.

In addition, a method of driving the organic light emitting display device according to example embodiments updates the efficiency changing region and the LUT such that an efficiency changing period increases as the accumulated driving time increases. Therefore, the method of driving the organic light emitting display device prevents or reduces the occurrence of afterimage and maintains a display quality for a relatively longer period of time.

BRIEF DESCRIPTION OF THE DRAWINGS

Example embodiments will be described more fully hereinafter with reference to the accompanying drawings, in which various embodiments are shown.

DETAILED DESCRIPTION

Figure 1:
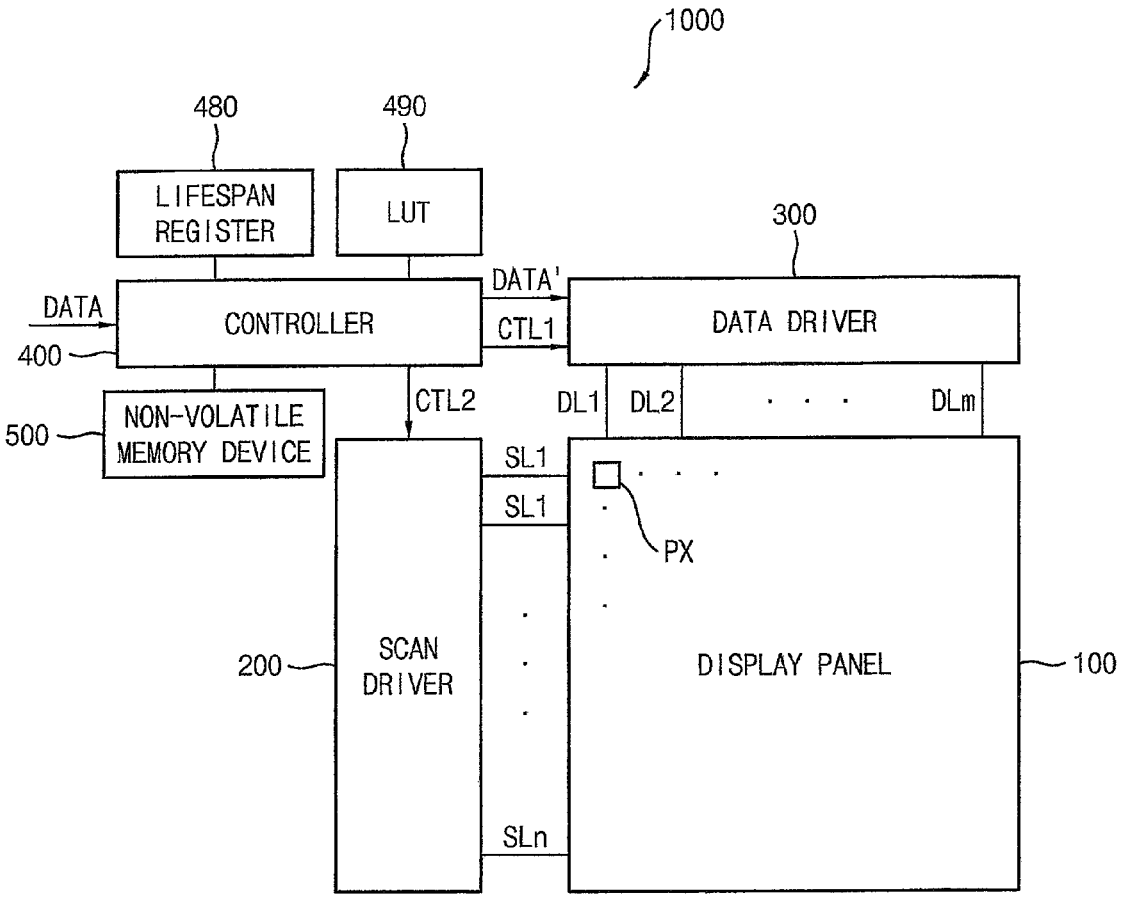
FIG. 1 is a block diagram illustrating an organic light emitting display device according to example embodiments.

Example embodiments will be described more fully hereinafter with reference to the accompanying drawings, in which various embodiments are shown. Hereinafter, example embodiments will be described in more detail with reference to the accompanying drawings, in which like reference numbers refer to like elements throughout. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating an organic light emitting display device according to example embodiments.

Referring to FIG. 1, the organic light emitting display device 1000 may include a display panel 100, a scan driver 200, a data driver 300, a controller 400, a lifespan register 480, a look-up table (LUT) 490, and a non-volatile memory device 500.

The display panel 100 may include a plurality of pixels PX. The display panel 100 may be coupled to the scan driver 200 via scan lines SL1 through SLn. The display panel 100 may be coupled to the data driver 300 via data lines DL1 through DLm. The display panel 100 may include n*m pixels PX because the pixels PX are arranged at locations corresponding to crossing points of the scan lines SL1 through SLn and the data lines DL1 through DLm.

The scan driver 200 may provide scan signals to the pixels PX via the scan lines SL1 through SLn.

The data driver 300 may provide data signals to the pixels PX via the data lines DL1 through DLm.

Deterioration data of the pixels PX may be accumulatively stored in the lifespan register 480 while the display panel 100 is driven. Thus, the deterioration data may be accumulatively stored in the lifespan register 480 by adding the deterioration data stored in the lifespan register 480 and frame data included in input image data DATA.

In one example embodiment, the deterioration data for each pixel PX may be stored in the lifespan register 480. To correctly compensate deterioration of the pixels PX, the deterioration data may be stored in the lifespan register 480 by the pixel unit. In another example embodiment, the deterioration data for each pixel block may be stored in the lifespan register 480. Because the manufacturing cost and power consumption may increase as capacity of the deterioration data increases, the deterioration data may be stored in the lifespan register 480 by the pixel block unit to reduce the manufacturing cost and the power consumption. For example, each pixel block may include 16 pixels that are arranged in 4*4 square. An average value of the input image data DATA corresponding to each pixel block may be stored in the lifespan register 480 as the deterioration data. A size of the lifespan register 480 may be determined in consideration of a life guaranteed time and a bandwidth of the memory access.

In addition, the lifespan register 480 may include an efficiency changing region for deriving the efficiency value of the pixel PX from the LUT 490. Hereinafter, a structure of the lifespan register 480 will be described in more detail with reference to the FIG. 3.

The efficiency curve indicating a relation between an accumulated driving time and an efficiency value of the pixels PX may be stored in the LUT 490. Thus, the efficiency curve shows a luminance degradation of pixels PX according to the accumulated driving time. Because the capacity of the LUT 490 may be limited, the efficiency curve may include the efficiency values according to the accumulated driving time with a predetermined interval (e.g., an efficiency changing period). Therefore, the efficiency values may be derived from the LUT 490 by an interpolation technique.

The LUT 490 may be a volatile memory device. The volatile memory device cannot maintain the data while the power is not supplied. However, the volatile memory device can relatively quickly read or write data. For example, the LUT 490 may include a dynamic random access memory (DRAM), a static random access memory (SRAM), a mobile DRAM, etc.

The LUT 490 may be updated by the controller 400 to correctly compensate the deterioration of the pixels PX, especially in the beginning period of deterioration, and to sufficiently secure a life guaranteed time. Hereinafter, the efficiency curve stored in the LUT 490 will be described in more detail with reference to the FIG. 4.

The controller 400 may update the efficiency changing region and the LUT 490 based on the accumulated driving time. The accumulated deterioration data can be converted into the accumulated driving time as temporal concept. For example, the accumulated driving time may be calculated by dividing the accumulated deterioration data by a maximum frame data corresponding to a maximum luminance. Thus, when the controller 400 continuously receives the maximum frame data during the accumulated driving time, the accumulated deterioration data may be stored in the lifespan register 480. The controller 400 may determine whether the efficiency changing region and the LUT 490 are needed to be updated by monitoring the lifespan register 480.

In one example embodiment, the controller 400 may update the efficiency changing region and the LUT 490 when a value of a monitoring region included in the lifespan register 480 is changed. The controller 400 may update the efficiency changing region and the LUT 490 in order that the efficiency changing period increases as the accumulated driving time increases.

In a first region in which the accumulated driving time is relatively small, because an efficiency degradation of the pixel PX may be relatively large, the efficiency values derived from LUT 490 using the interpolation technique may have an error. Therefore, in the first region in which the accumulated driving time is relatively small, to correctly compensate the deterioration of the pixel PX using the interpolation technique, the efficiency changing region and the LUT 490 may be updated such that the efficiency changing period is relatively short.

Alternatively, a second region in which the accumulated driving time is relatively large, the efficiency degradation of the pixel PX may be relatively small. Therefore, to sufficiently secure the life guaranteed time, the efficiency changing region and the LUT 490 may be updated such that the efficiency changing period is relatively long.

The controller 400 may convert the input image data DATA into the output image data DATA' using the efficiency changing region and the LUT 490. For example, the controller 400 may derive the efficiency value from the LUT 490 using a value of the efficiency changing region as an index of the LUT 490. The controller 400 may derive compensation weight for each of the pixels PX using the efficiency value. The controller 400 may generate the output image data DATA' by multiplying the input image data DATA by the compensation weight.

In addition, the controller 400 may provide control signals CTL1, CTL2 corresponding to the output image data DATA' to the scan driver 200 and the data driver 300, thereby controlling the scan driver 200 and the data driver 300.

Hereinafter, the controller 400 will be described in more detail with reference to the FIGS. 2 and 13.

The non-volatile memory device 500 may store the deterioration data and the efficiency curve while the power is not supplied. The non-volatile memory device 500 may be located outside of the controller 400. The non-volatile memory device 500 may have a variety of characteristics such as capability to store mass data, low cost, etc. For example, the non-volatile memory device 500 may include flash memory, erasable programmable read-only memory (EPROM), electrically erasable programmable read-only memory (EEPROM), phase change random access memory (PRAM), resistance random access memory (RRAM), nano floating gate memory (NFGM), polymer random access memory (PoRAM), magnetic random access memory (MRAM), ferroelectric random access memory (FRAM), etc.

The non-volatile memory device 500 may stably store the deterioration data because the non-volatile memory device 500 can maintain the data while the power is not supplied. In one example embodiment, the deterioration data may be accumulatively stored in the non-volatile memory device 500 as time passes. The accumulated deterioration data can be used for restore damaged deterioration data or enhancing performance of the display panel 100. In one example embodiment, the deterioration data may be periodically read from the lifespan register 480, and the read deterioration data may be stored in the non-volatile memory device 500. In another example embodiment, the deterioration data stored may be read from the lifespan register 480 at a predetermined time, and the read deterioration data may be stored in the non-volatile memory device 500.

In addition, because the non-volatile memory device 500 can store mass data, the non-volatile memory device 500 may store a plurality of efficiency curves, and provide the efficiency curve corresponding to the lifespan register 480 to the LUT 490.

Also, the organic light emitting display device 1000 may further include a power supply providing the high power voltage and low power voltage to the display panel 100, an emission driver providing emission signals to the pixels PX, etc.

Although the example embodiments of FIG. 1 describe that the lifespan register 480 and the LUT 490 are located outside of the controller 400, the lifespan register 480 and the LUT 490 can be located inside of the controller 400.

The organic light emitting display device 1000 may update the efficiency changing region and the LUT 490 such that the efficiency changing period increases as the accumulated driving time increases. Therefore, the organic light emitting display device 1000 correctly compensates deterioration of the pixels PX, especially in the beginning period of deterioration. The organic light emitting display device 1000 sufficiently secures the life guaranteed time indicating a time capable of compensating deterioration of the pixels PX using the updated deterioration data.

Figure 2:
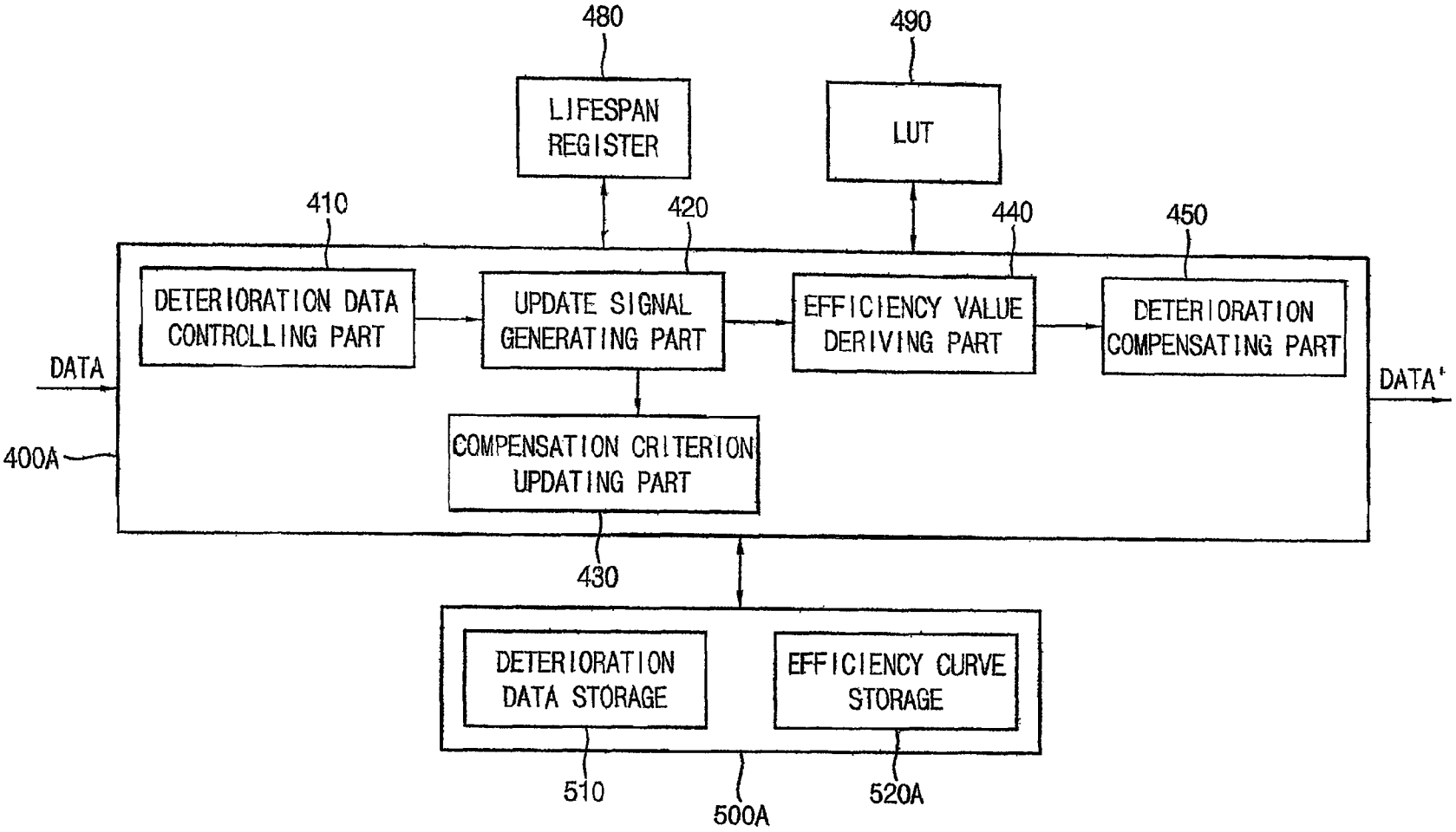
FIG. 2 is a block diagram illustrating one example of a controller included in an organic light emitting display device of FIG. 1.

FIG. 2 is a block diagram illustrating one example of a controller included in an organic light emitting display device of FIG. 1.

Referring to FIG. 2, the controller 400A may include a deterioration data controlling part (or deterioration data controller) 410, an update signal generating part (or update signal generator) 420, a compensation criterion updating part (or compensation criterion updater) 430, an efficiency value deriving part (or efficiency value deriver) 440, and a deterioration compensating part (or deterioration compensator) 450.

The deterioration data controlling part 410 may accumulatively store deterioration data in a lifespan register 480 based on input image data DATA. Thus, the deterioration data controlling part 410 may accumulatively store the deterioration data by adding the deterioration data stored in the lifespan register 480 and frame data included in the input image data DATA. The deterioration data controlling part 410 may store the deterioration data in the lifespan register 480 by a pixel unit or a pixel block unit.

In addition, the deterioration data controlling part 410 may read the deterioration data from the lifespan register 480, and store the deterioration data in a deterioration data storage 510 of a non-volatile memory device 500A to maintain the deterioration data while the power is not supplied, and to store the deterioration data as time passes. In one example embodiment, the deterioration data controlling part 410 periodically reads the deterioration data from the lifespan register 480, and stores the deterioration data in the non-volatile memory device 500A. In another example embodiment, the deterioration data controlling part 410 may read the deterioration data from the lifespan register 480 at a predetermined time, and store the deterioration data in the non-volatile memory device 500A. For example, the deterioration data controlling part 410 may read the deterioration data from the lifespan register 480 when the display panel is turned off, and store the deterioration data in the non-volatile memory device 500A.

Also, the deterioration data controlling part 410 may configure the lifespan register 480 using the deterioration data stored in the non-volatile memory device 500A when the display panel is initialized. The deterioration data controlling part 410 may configure the LUT 490 using the efficiency curve stored in the efficiency curve storage 520A of the non-volatile memory device 500A when the display panel is initialized.

The update signal generating part 420 may generate an update signal based on the accumulated driving time. The update signal generating part 420 may determine whether or not the efficiency changing region and the LUT 490 will be updated by monitoring the lifespan register 480. In one example embodiment, the update signal generating part 420 may generate the update signal when a value of a monitoring region included in the lifespan register 480 is changed. For example, when a size of the monitoring region is one bit and the value of the monitoring region is changed from 0 to 1, the update signal generating part 420 may confirm that the accumulated driving time exceeds a current threshold value. Therefore, when the monitoring region is changed, the update signal generating part 420 may generate the update signal and shift the monitoring region by one bit to compare the accumulated driving time with a next threshold value.

The compensation criterion updating part 430 may update the efficiency changing region in the lifespan register 480 and the LUT 490 in response to the update signal such that an efficiency changing period increases as the accumulated driving time increases. In a first region in which the accumulated driving time is relatively small, an efficiency degradation of the pixel is relatively large in comparison with a second region in which the accumulated time is relatively large. Therefore, in the first region in which the accumulated driving time is relatively small, the compensation criterion updating part 430 may update the efficiency changing region and the LUT 490 such that the efficiency changing period is relatively short to correctly compensate the deterioration of the pixel PX using the interpolation technique. On the other hand, the second region in which the accumulated driving time is relatively large, the compensation criterion updating part 430 may update the efficiency changing region and the LUT 490 such that the efficiency changing period is relatively long to sufficiently secure the life guaranteed time.

In one example embodiment, the compensation criterion updating part 430 may shift the efficiency changing region by one bit in response to the update signal. Thus, the compensation criterion updating part 430 may update the efficiency changing region and the LUT 490 to approximately double the efficiency changing period in response to the update signal.

In one example embodiment, the compensation criterion updating part 430 may load the efficiency curve corresponding to the efficiency changing region from the non-volatile memory device 500A into the LUT 490 in response to the update signal. A plurality of efficiency curves corresponding to efficiency changing regions may be generated in advance, and the efficiency curves may be stored in the efficiency curve storage 520A. The compensation criterion updating part 430 may load the efficiency curve corresponding to the efficiency changing region from the efficiency curve storage 520A into the LUT 490 in response to the update signal. For example, the compensation criterion updating part 430 may load the efficiency curve of which the efficiency changing period is increased in double into the LUT 490.

In one example embodiment, the compensation criterion updating part 430 may be included in a micro control unit (MCU). The efficiency changing region and the LUT 490 may be updated using the MCU without additional processor, thereby reducing the manufacturing cost.

The efficiency value deriving part 440 may derive the efficiency value of the pixel using the efficiency changing region in the lifespan register 480 and the LUT 490. The efficiency value of the pixel is defined as a ratio of a luminance of the pixel to an initial luminance of an initial pixel that is not degraded. In one example embodiment, the efficiency value deriving part 440 may derive the efficiency value of each of the pixels from the LUT 490 using a value of the efficiency changing region as an index of the LUT 490. For example, the efficiency value deriving part 440 may derive the efficiency value for the first pixel from the LUT 490 using the value of the efficiency changing region corresponding to the first pixel as the index of the LUT 490.

The deterioration compensating part 450 may convert the input image data DATA into the output image data DATA' using the efficiency value. The deterioration compensating part 450 may calculate the compensation weight for the pixel that is inversely proportional to the efficiency value. The deterioration compensating part 450 may generate the output image data DATA' by multiplying the input image data DATA by the compensation weight. Therefore, the deterioration compensating part 450 may generate the output image data DATA' by compensating an efficiency degradation of the pixels and output the output image data DATA'.

Also, the controller 400A may further include a timing controlling part generating timing control signals corresponding the output image data DATA'.

Figure 3:
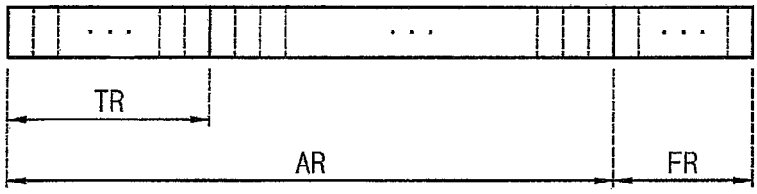
FIG. 3 is a diagram illustrating a lifespan register included in an organic light emitting display device of FIG. 1.

FIG. 3 is a diagram illustrating a lifespan register included in an organic light emitting display device of FIG. 1.

Referring to FIG. 3, the lifespan register may include a frame data accumulating region FR and a compensation time region AR. The frame data included in the input image data may be accumulatively stored in the lifespan register as the deterioration data.

The frame data in the input image data for each pixel or pixel block may be stored in the frame data accumulating region FR. Thus, the frame data are accumulatively summed in the frame data accumulating region FR. A size of the frame data accumulating region FR may correspond to a maximum value of the frame data. For example, when the maximum value of the frame data is 255, the size of the frame data accumulating region FR may be 8 bits.

A size of the compensation time region AR is defined as a time capable of accumulatively storing the deterioration data when the frame data maintains the maximum value. Thus, the size of the compensation time region AR is defined as a life guaranteed time. The life guaranteed time is a period in which the deterioration of the pixels is compensated using the deterioration data. Therefore, the deterioration data may be accumulatively stored until the accumulated driving time reaches to the life guaranteed time.

The compensation time region AR may include an efficiency changing period TR. The efficiency value of the pixel may be derived from the LUT using the efficiency changing period TR. For example, the efficiency value may be derived from the LUT using a value of the efficiency changing region TR as an index of the LUT. The efficiency changing region TR may be shifted to change the efficiency changing period. The efficiency changing region TR may be shifted to increase the efficiency changing period as the accumulated driving time increases. Also, the compensation time region AR may be adjusted to increase the efficiency changing period.

Figure 4:
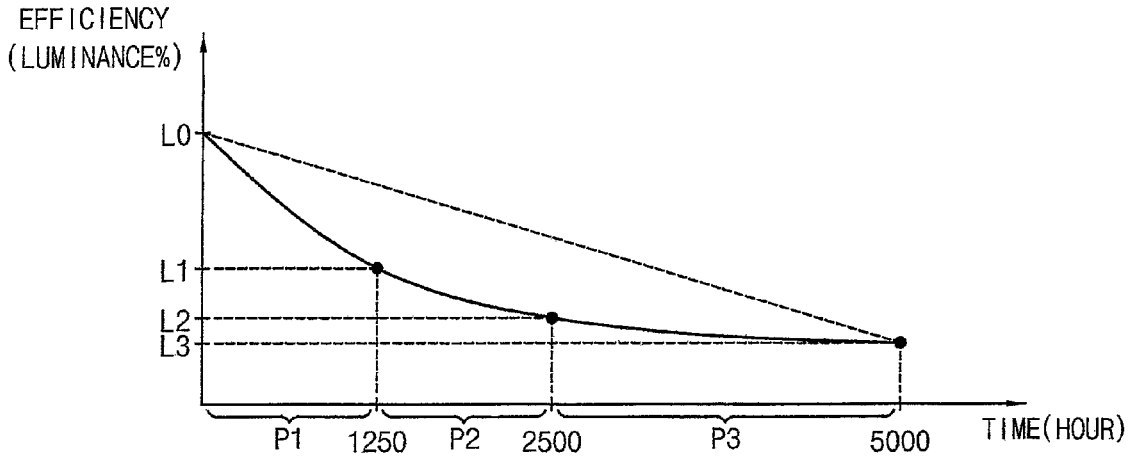
FIG. 4 is a graph illustrating an efficiency curve stored in a LUT of an organic light emitting display device of FIG. 1.

FIG. 4 is a graph illustrating an efficiency curve stored in a LUT of an organic light emitting display device of FIG. 1.

Referring to FIG. 4, in the efficiency curve stored in the LUT, an efficiency degradation of the pixel may decrease as the accumulated driving time increases. Thus, luminance of the pixel may not decrease linearly in proportion to the accumulated driving time, but instead the luminance of the pixel may decrease more rapidly in the beginning period of deterioration.

For example, an absolute value of the slope of the efficiency curve may decrease as the accumulated driving time increases. For example, as the accumulated driving time increases from 0 hour to 1250 hours, the efficiency of the pixel may decrease from L0 to L1. As the accumulated driving time increases from 1250 hours to 2500 hours, the efficiency of the pixel may decrease from L1 to L2, where the difference in luminance between L0 and L1 is greater than the difference in luminance between L1 and L2. As the accumulated driving time increases from 2500 hours to 5000 hours, the efficiency of the pixel may decrease from L2 to L3, where the difference in luminance between L2 and L3 is less than the difference in luminance between L1 and L2. Here, a first difference between L0 and L1 (i.e., L0−L1) is greater than a second difference between L1 and L2 (i.e., L1−L2). Also, the second difference between L1 and L2 (i.e., L1−L2) is greater than a third difference between L2 and L3 (i.e., L2−L3).

If the efficiency curve included in the LUT is not changed, the afterimage may occur due to the initial deterioration or the life guaranteed time may be shortened. For example, when the LUT include a first efficiency curve of which the efficiency changing period is relatively short, the life guaranteed time may be sufficiently secured because a memory capacity of the LUT is limited. On the other hand, when the LUT includes a third efficiency curve of which the efficiency changing period is relatively long, the afterimage may occur because the interpolation technique may not sufficiently compensate for the initial deterioration. Therefore, the efficiency curve in the LUT may be updated such that an efficiency changing period increases as the accumulated driving time increases. For example, the LUT may include the first efficiency curve of which the efficiency changing period is relatively short during a first region P1 in which the accumulated driving time is between 0 and 1250 hours. The LUT may include the third efficiency curve of which the efficiency changing period is relatively long during a third region P3 in which the accumulated driving time is between 2500 and 3000 hours.

Figure 5:
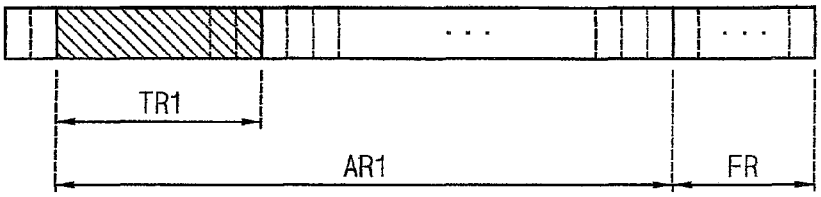
FIG. 5 is a diagram illustrating an example of an efficiency changing region and a compensation time region of a lifespan register.
Figure 6:
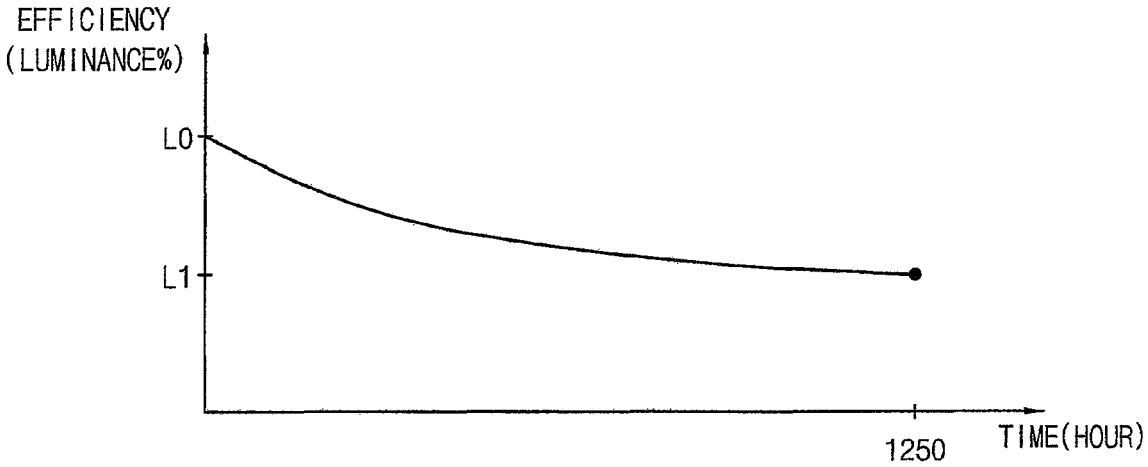
FIG. 6 is a graph illustrating an efficiency curve corresponding to a lifespan register of FIG. 5.

FIG. 5 is a diagram illustrating an example of an efficiency changing region and a compensation time region of a lifespan register. FIG. 6 is a graph illustrating an efficiency curve corresponding to a lifespan register of FIG. 5.

Referring to FIGS. 5 and 6, the first efficiency curve of which the efficiency changing period is relatively short may be used in the first region in which the accumulated driving time is relatively small (e.g., the accumulated driving time is between 0 and 1250 hours like as P1 of FIG. 4), thereby correctly compensating for the initial deterioration.

A first efficiency changing region TR1 of the lifespan register may be set to shorten the efficiency changing period. The LUT may include the first efficiency curve of which the efficiency changing period is relatively short. For example, the lifespan register may include the first efficiency changing region TR1 for setting the efficiency changing period as 1.25 hours, and a first compensation time region AR1 for setting the life guaranteed time as 1250 hours. The LUT may include the first efficiency curve of which the efficiency changing period is 1.25 hour and of which the life guaranteed time is 1250 hours. Because an efficiency value of the pixels may be derived from the first efficiency curve of which the efficiency changing period is relatively short, the deterioration of the pixels may be correctly compensated using the interpolation technique.

Figure 7:
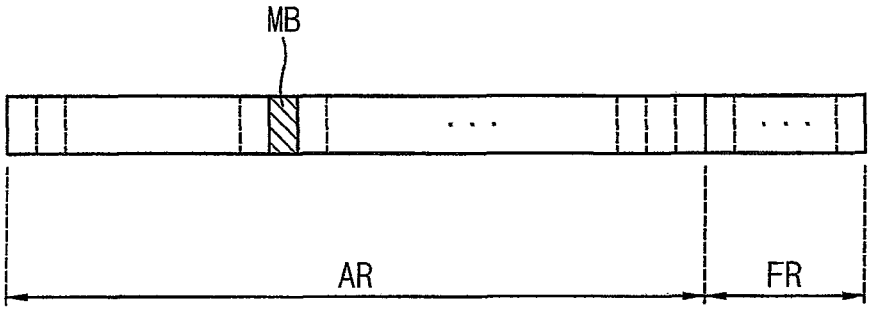
FIG. 7 is a diagram for describing an operation of generating an update signal using a monitoring region of a lifespan register of FIG. 5.

FIG. 7 is a diagram for describing an operation of generating an update signal using a monitoring region of a lifespan register of FIG. 5.

Referring to FIG. 7, an update signal generating part may determine whether the efficiency changing region and the LUT are needed to be updated by monitoring the lifespan register. In one example embodiment, when the value of the monitoring region MB is changed, the update signal generating part may generate an update signal. In one example embodiment, a size of the monitoring region MB may be one bit. The monitoring region MB may be shifted by one bit when the value of the monitoring region MB is changed. For example, the monitoring region MB may be set to determine whether or not the accumulated driving time exceeds 1250 hours. When the monitoring region MB may be changed from 0 to 1, the update signal generating part may determine that the accumulated driving time exceeds a first threshold value (e.g., 1250 hours) and may generate the update signal. Also, the monitoring region MB may be shifted to compare the accumulated driving time and a second threshold value (e.g., 2500 hours).

Figure 8:
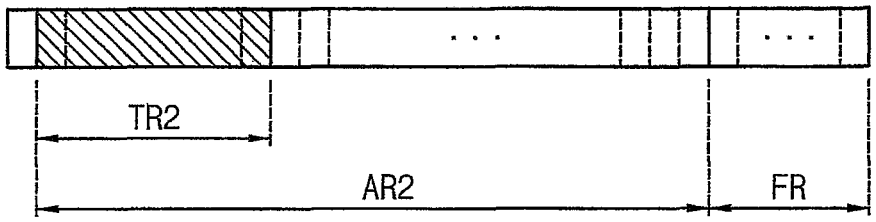
FIG. 8 is a diagram illustrating an example of updating an efficiency changing region and a compensation time region of FIG. 5.
Figure 9:
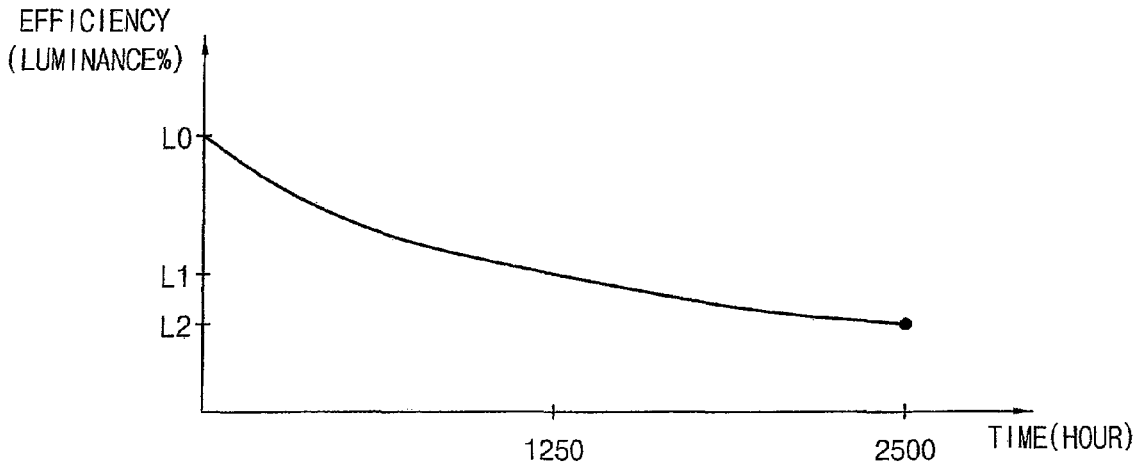
FIG. 9 is a graph illustrating an efficiency curve corresponding to a lifespan register of FIG. 8.
Figure 10:
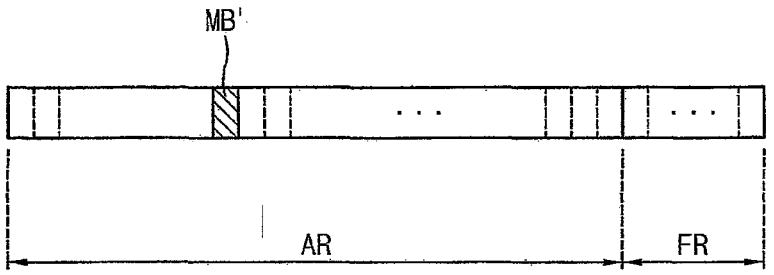
FIG. 10 is a diagram for describing an operation of generating an update signal using a monitoring region of a lifespan register of FIG. 8.

FIG. 8 is a diagram illustrating an example of updating an efficiency changing region and a compensation time region of FIG. 5. FIG. 9 is a graph illustrating an efficiency curve corresponding to a lifespan register of FIG. 8. FIG. 10 is a diagram for describing an operation of generating an update signal using a monitoring region of a lifespan register of FIG. 8.

Referring to FIGS. 8 through 10, as the accumulated driving time increases, the lifespan register of FIG. 5 and the LUT of FIG. 6 may be updated.

As shown in FIG. 8 and FIG. 9, an efficiency changing region and a compensation time region may be updated as the accumulated driving time increases to increase an efficiency changing period. For example, when the accumulated driving time increases from a first region to a second region, thus when the accumulated driving time exceeds 1250 hours, the LUT is updated using a second efficiency curve. A second efficiency changing period of the second efficiency curve corresponding to the second region may be greater than a first efficiency changing period of a first efficiency curve corresponding to the first region.

The efficiency changing region of the lifespan register may be updated to increase the efficiency changing period. Also, the LUT include the second efficiency curve of which the efficiency changing period is lengthened corresponding to the efficiency changing region. For example, the lifespan register may include a second efficiency changing region TR2 for setting the efficiency changing period as 2.5 hours, and a second compensation time region AR2 for setting the life guaranteed time as 2500 hours. The LUT may include the second efficiency curve of which the efficiency changing period is 2.5 hour and of which life guaranteed time is 2500 hours.

As shown in FIG. 10, an update signal generating part may determine whether the efficiency changing region and the LUT are needed to be updated by monitoring the monitoring region MB'. For example, the monitoring region MB' may be set to determine whether the accumulated driving time exceeds 2500 hours. When the monitoring region MB' may be changed from 0 to 1, the update signal generating part may determine that the accumulated driving time exceeds a second threshold value (e.g., 2500 hours) and may generate the update signal. Also, the monitoring region MB' may be shifted by one bit to compare the accumulated driving time and a third threshold value (e.g., 5000 hours).

Figure 11:
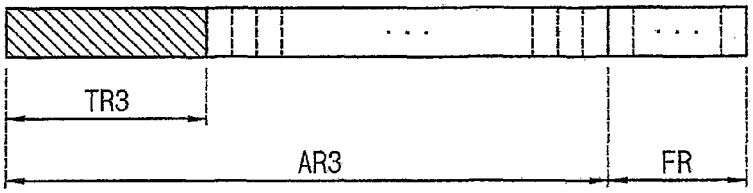
FIG. 11 is a diagram illustrating an example of updating an efficiency changing region and a compensation time region of FIG. 8.
Figure 12:
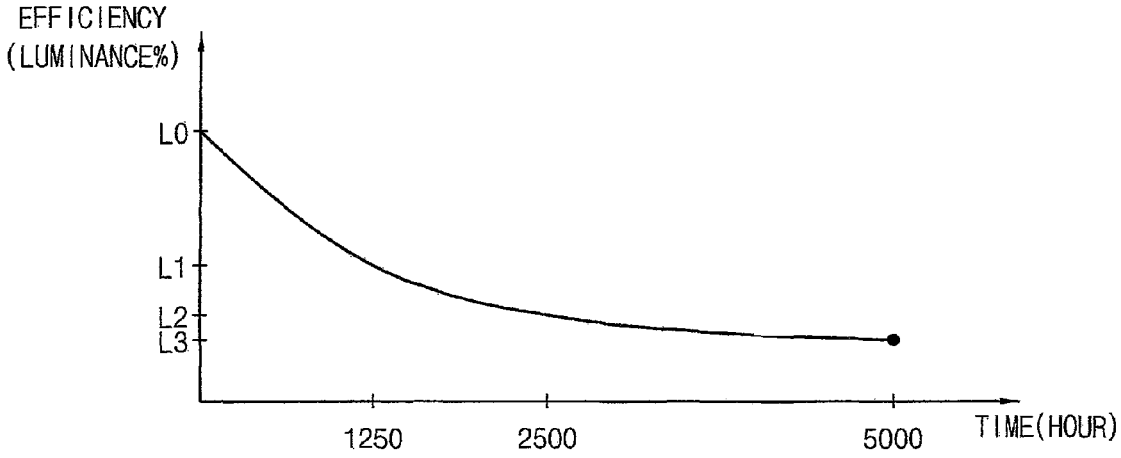
FIG. 12 is a graph illustrating an efficiency curve corresponding to a lifespan register of FIG. 11.

FIG. 11 is a diagram illustrating an example of updating an efficiency changing region and a compensation time region of FIG. 8. FIG. 12 is a graph illustrating an efficiency curve corresponding to a lifespan register of FIG. 11.

Referring to FIGS. 11 and 12, an efficiency changing region and a compensation time region may be updated as the accumulated driving time increases to increase an efficiency changing period. For example, when the accumulated driving time increases from a second region to a third region. Thus, when the accumulated driving time exceeds 2500 hours, the LUT is updated using a third efficiency curve. A third efficiency changing period of the third efficiency curve corresponding to the third region may be greater than a second efficiency changing period of a second efficiency curve corresponding to the second region. Therefore, the third efficiency curve of which the efficiency changing period is relatively long may be used in the third region in which the accumulated driving time is relatively large, thereby sufficiently securing the life guaranteed time.

The efficiency changing region of the lifespan register may be updated to increase the efficiency changing period. Also, the LUT include the third efficiency curve of which the efficiency changing period is lengthened corresponding to the efficiency changing region. For example, the lifespan register may include a third efficiency changing region TR3 for setting the efficiency changing period as 5 hours, and a third compensation time region AR3 for setting the life guaranteed time as 5000 hours. The LUT may include the third efficiency curve of which the efficiency changing period is 5 hour and of which life guaranteed time is 5000 hours corresponding to the third efficiency changing region TR3. Because an efficiency value of the pixels may be derived using the third efficiency curve of which the efficiency changing period is relatively long, the life guaranteed time may be sufficiently secured using the interpolation technique with limited resources.

Although the example embodiments of FIGS. 5 through 12 describe that the efficiency changing region of the lifespan register and the LUT are updated to double the efficiency changing period as the accumulated driving time increases, the efficiency changing region and the LUT is updated are updated to increase the efficiency changing period in various methods. In addition, although the example embodiments of FIGS. 7 and 10 describe that the size of the monitoring region is one bit, the size of the monitoring region is larger than one bit and the lifespan register and the LUT are updated on the basis of various threshold values.

Figure 13:
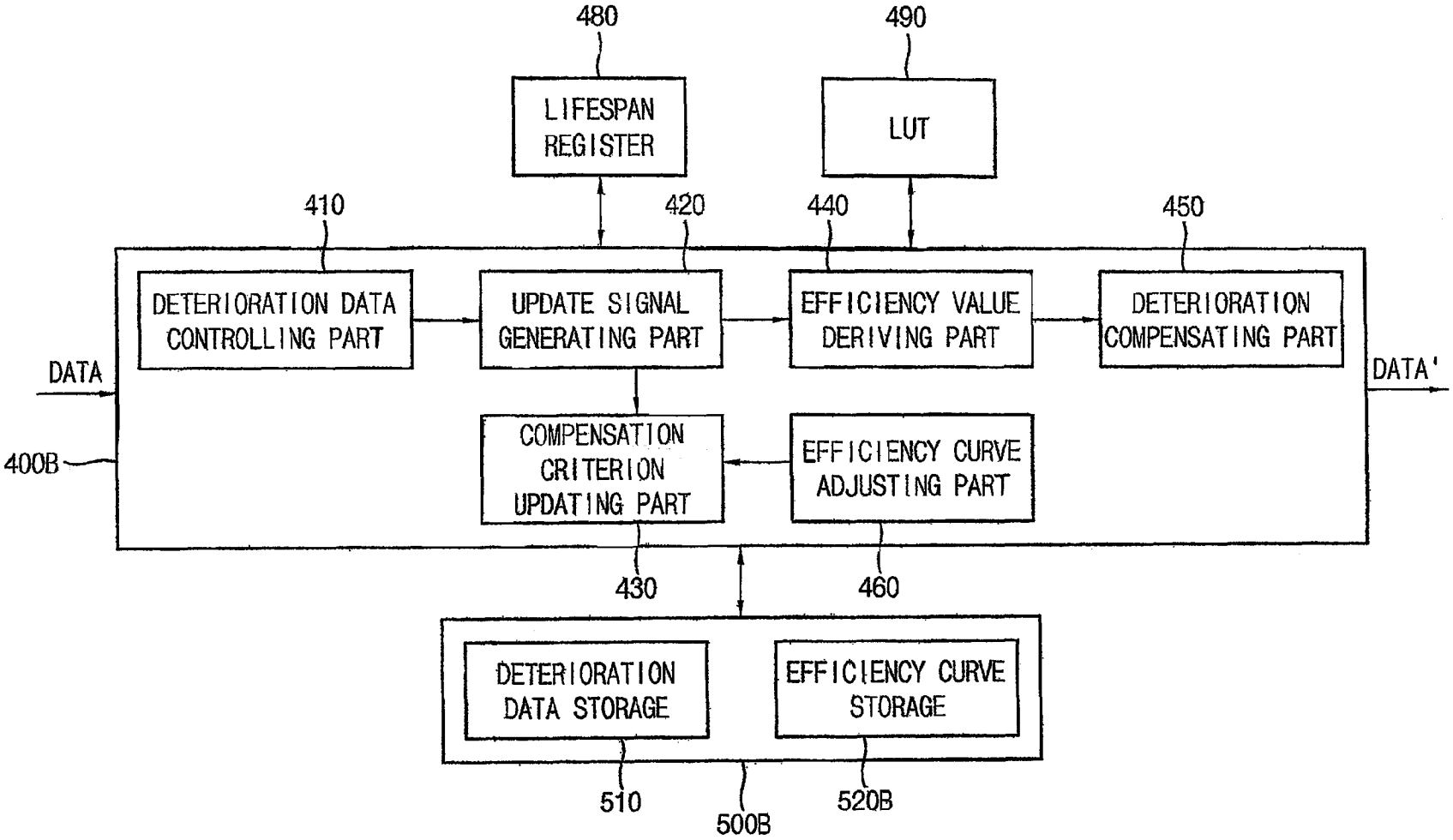
FIG. 13 is a block diagram illustrating another example of a controller included in an organic light emitting display device of FIG. 1.

FIG. 13 is a block diagram illustrating another example of a controller included in an organic light emitting display device of FIG. 1.

Referring to FIG. 13, the controller 400B may include a deterioration data controlling part (or deterioration data controller) 410, an update signal generating part (or update signal generator) 420, a compensation criterion updating part (or compensation criterion generator) 430, an efficiency value deriving part (or efficiency value deriver) 440, a deterioration compensating part (or deterioration compensator) 450, and an efficiency curve adjusting part (or efficiency curve adjustor) 460. The controller 400B according to the present example embodiment is substantially the same as the controller of the example embodiment described in FIG. 2, except that the efficiency curve adjusting part 460 is added. Therefore, the same reference numerals will be used to refer to the same or like parts as those described in the previous example embodiment of FIG. 2, and any repetitive explanation concerning the above elements will be omitted.

The deterioration data controlling part 410 may accumulatively store deterioration data in a lifespan register 480 based on input image data DATA. In addition, the deterioration data controlling part 410 may read the deterioration data from the lifespan register 480, and store the deterioration data in a deterioration data storage 510 of a non-volatile memory device 500B to maintain the deterioration data while the power is not supplied or to store the deterioration data as time passes.

The update signal generating part 420 may generate an update signal based on the accumulated driving time. The update signal generating part 420 may determine whether the efficiency changing region and the LUT are needed to be updated by monitoring the lifespan register 480. In one example embodiment, the update signal generating part 420 may generate the update signal when a value of a monitoring region included in the lifespan register 480 is changed.

The efficiency curve adjusting part 460 may scale the efficiency curve corresponding to the efficiency changing region when the efficiency changing region is changed. In one example embodiment, the efficiency curve adjusting part 460 may scale the efficiency curve to approximately double the efficiency changing period in response to the update signal. For example, the efficiency curve adjusting part 460 may scale the efficiency curve included in the LUT or the efficiency curve storage 520B of the non-volatile memory device 500B to approximately double the efficiency changing period.

The compensation criterion updating part 430 may update the efficiency changing region in the lifespan register 480 and the LUT 490 in response to the update signal such that an efficiency changing period increases as the accumulated driving time increases. The compensation criterion updating part 430 may update the LUT 490 using the scaled efficiency curve scaled by the efficiency curve adjusting part 460 in response to the update signal. When a plurality of pre-generated efficiency curves is stored in the non-volatile memory device like FIG. 2, large capacity of the non-volatile memory device may be needed. Therefore, the compensation criterion updating part 430 may update the LUT 490 using the scaled efficiency curve scaled by the efficiency curve adjusting part 460, thereby reducing the capacity of the non-volatile memory device 500B.

The efficiency value deriving part 440 may derive the efficiency value using the efficiency changing region in the lifespan register 480 and the LUT 490.

The deterioration compensating part 450 may convert the input image data DATA into the output image data DATA' using the efficiency value.

Also, the controller 400B may further include a timing controlling part generating timing control signals corresponding the output image data DATA'.

Figure 14:
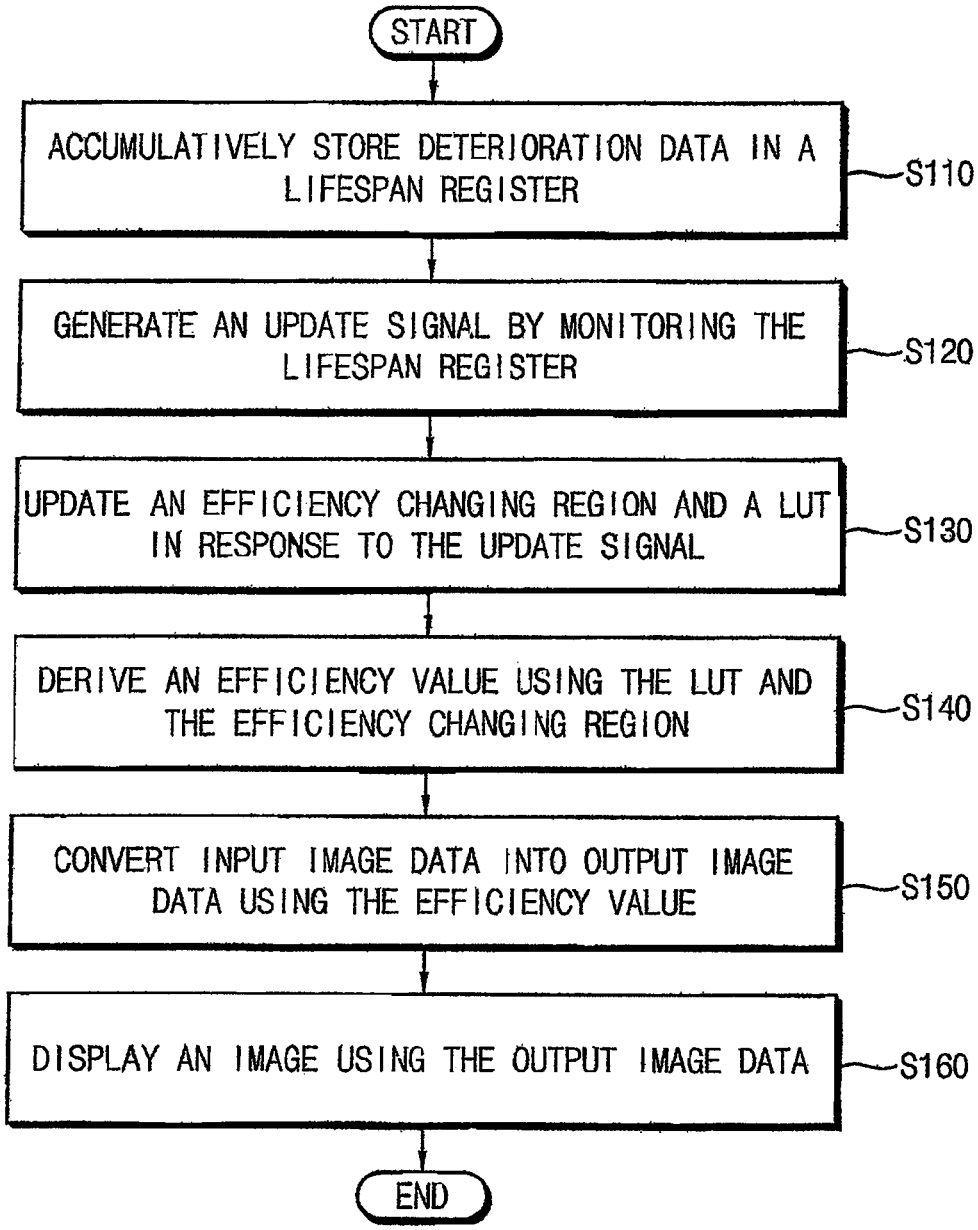
FIG. 14 is a flow chart illustrating a method of driving an organic light emitting display device according to example embodiments.

FIG. 14 is a flow chart illustrating a method of driving an organic light emitting display device according to example embodiments.

Referring to FIG. 14, the method of driving the organic light emitting display device may update an efficiency changing region in the lifespan register and LUT such that an efficiency changing period increases as the accumulated driving time increases. Therefore, the method of driving the organic light emitting display device may prevent the occurrence (or reduce instances of) of afterimage in beginning period of deterioration, may sufficiently secure the life guaranteed time, and may maintain a display quality for a long time.

Deterioration data of pixels may be accumulatively stored in a lifespan register based on input image data (Step S110). Frame data included in the input image data may be accumulatively stored in the lifespan register as the deterioration data by a pixel unit or a pixel block unit.

An accumulated driving time of the pixels may be derived from the lifespan register, and an update signal may be generated based on the accumulated driving time (Step S120). The update signal may be generated by monitoring the lifespan register and determining whether the efficiency changing region and the LUT are needed to be updated. In one example embodiment, the update signal may be generated when a value of a monitoring region in the lifespan register is changed. For example, when a size of the monitoring region is one bit and the monitoring region is changed from 0 to 1, it is confirmed that the accumulated driving time exceeds a predetermined a current threshold value. Therefore, when the value of the monitoring region is changed, the update signal is generated and the monitoring region is shifted by one bit to compare the accumulated driving time with a next threshold value.

The efficiency changing region in the lifespan register and the LUT may be updated in response to the update signal such that an efficiency changing period increases as the accumulated driving time increases (Step S130). In a first region in which the accumulated driving time is relatively small, an efficiency degradation of the pixel is relatively large in comparison with a second region in which the accumulated time is relatively large. Therefore, in the first region in which the accumulated driving time is relatively small, the efficiency changing region and the LUT may be updated such that the efficiency changing period is set relatively short to correctly compensate the deterioration of the pixel PX. On the other hand, the second region in which the accumulated driving time is relatively large, the efficiency changing region and the LUT may updated such that the efficiency changing period is set relatively long to sufficiently secure the life guaranteed time.

In one example embodiment, the efficiency changing region may be shifted by one bit in response to the update signal. Thus, the efficiency changing region and the LUT may updated to approximately double the efficiency changing period in response to the update signal indicating that the accumulated driving time is increased greater than a threshold value (e.g., a predetermined threshold value).

In one example embodiment, the efficiency curve corresponding to the efficiency changing region may be loaded from the non-volatile memory device into the LUT in response to the update signal. A plurality of efficiency curves corresponding to efficiency changing regions may be generated in advance, and the efficiency curves may be stored in the efficiency curve storage. The efficiency curve corresponding to the efficiency changing region may be loaded from the efficiency curve storage into the LUT in response to the update signal. For example, the efficiency curve of which the efficiency changing period is increased in double may be loaded from non-volatile memory device into the LUT.

In another example embodiment, the LUT may be updated by scaling the efficiency curve in response to the update signal. For example, the efficiency curve may be scaled to approximately double the efficiency changing period in response to the update signal. Therefore, the LUT may be updated using the scaled efficiency curve, thereby reducing the capacity of the non-volatile memory device.

The efficiency value may be derived from the LUT using a value of the efficiency changing region as an index of the LUT (Step S140). For example, the efficiency value for the first pixel from the LUT using the value of the efficiency changing region corresponding to the first pixel as the index of the LUT.

The input image data may be converted into output image data using the efficiency value (Step S150). The compensation weight for each of the pixels may be derived using the efficiency value. The output image data may be generated by multiplying the input image data by the compensation weight. Therefore, the input image data may be converted into the output image data by compensating the efficiency degradation by the deterioration of the pixels.

An image may be displayed using the output image data (Step S160). Because the organic light emitting display device displays the image using the output image data that are compensated for the deterioration of the pixels, the organic light emitting display device prevents the occurrence of afterimage and maintains a display quality for a long time.

Although the example embodiments describe that the non-volatile memory device is located inside of the organic light emitting display device, the non-volatile memory device can be located outside of the organic light emitting display device.

Embodiments of the present invention may be applied to an electronic device having the display device. For example, embodiments of the present invention may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of the present invention. Accordingly, all such modifications are intended to be included within the scope of the present invention as defined in the claims, and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. An organic light emitting display device comprising:

a display panel comprising a plurality of pixels;

a scan driver configured to provide scan signals to the pixels;

a data driver configured to provide data signals to the pixels;

a look-up table (LUT), wherein an efficiency curve indicating a relationship between an accumulated driving time and an efficiency value is stored in the LUT;

a lifespan register including an efficiency changing region for deriving the efficiency value of each of the pixels from the LUT, the lifespan register being configured to accumulatively store deterioration data of the pixels; and a controller configured to derive the accumulated driving time from the lifespan register, to update the efficiency changing region and the LUT based on the accumulated driving time, to convert input image data into output image data using the efficiency changing region and the LUT, and to provide control signals corresponding to the output image data to the scan driver and the data driver, wherein the efficiency changing region is updated to increase a period of the efficiency curve by shifting the efficiency changing region in the lifespan register.

2. The display device of claim 1, wherein the deterioration data for each of the pixels is stored in the lifespan register.

3. The display device of claim 1, wherein the deterioration data for each pixel block among a plurality of pixel blocks is stored in the lifespan register.

4. The display device of claim 1, wherein the controller comprises:

a deterioration data controller configured to accumulatively store the deterioration data in the lifespan register based on the input image data;

an update signal generator configured to generate an update signal based on the accumulated driving time;

a compensation criterion updater configured to update the efficiency changing region and the LUT in response to the update signal such that an efficiency changing period increases as the accumulated driving time increases;

an efficiency value deriver configured to derive the efficiency value using the efficiency changing region and the LUT; and a deterioration compensator configured to convert the input image data into the output image data using the efficiency value.

5. The display device of claim 4, wherein the compensation criterion updater shifts the efficiency changing region by one bit in response to the update signal.

6. The display device of claim 4, wherein the compensation criterion updater is configured to load the efficiency curve corresponding to the efficiency changing region from a non-volatile memory device into the LUT in response to the update signal.

7. The display device of claim 4, wherein the compensation criterion updater is included in a micro control unit (MCU).

8. The display device of claim 4, wherein the efficiency value deriver is configured to derive the efficiency value from the LUT using a value of the efficiency changing region as an index of the LUT.

9. The display device of claim 4, wherein the deterioration compensator is configured to derive compensation weight for each of the pixels using the efficiency value, and to generate the output image data by multiplying the input image data by the compensation weight.

10. The display device of claim 4, wherein the deterioration data controller is configured to periodically read the deterioration data from the lifespan register, and to store the deterioration data in a non-volatile memory device.

11. The display device of claim 4, wherein the deterioration data controller is configured to read the deterioration data from the lifespan register, and to store the deterioration data in a non-volatile memory device at a predetermined time.

12. The display device of claim 4, wherein the controller further comprises:

an efficiency curve adjuster configured to scale the efficiency curve corresponding to the efficiency changing region, and wherein the compensation criterion updater is configured to update the LUT using the scaled efficiency curve in response to the update signal.

13. The display device of claim 12, wherein the efficiency curve adjuster is configured to scale the efficiency curve to approximately double the efficiency changing period in response to the update signal.

14. The display device of claim 4, wherein the update signal generator is configured to generate the update signal when a value of a monitoring region included in the lifespan register is changed.

15. The display device of claim 14, wherein a size of the monitoring region is one bit, and wherein the monitoring region is shifted by one bit when the value of the monitoring region is changed.

16. The display device of claim 14, wherein a size of the monitoring region is larger than one bit.

17. A method of driving an organic light emitting display device, the method comprising:

accumulatively storing deterioration data of pixels in a lifespan register based on input image data;

deriving an accumulated driving time of the pixels from the lifespan register;

generating an update signal based on the accumulated driving time;

updating an efficiency changing region in the lifespan register and a look-up table (LUT) in response to the update signal such that an efficiency changing period increases as the accumulated driving time increases, an efficiency curve indicating a relation between the accumulated driving time, and an efficiency value stored in the LUT;

deriving the efficiency value of each of the pixels from the LUT using a value of the efficiency changing region as an index of the LUT;

converting the input image data into output image data using the efficiency value; and displaying an image using the output image data, wherein the efficiency changing region is updated to increase the efficiency changing period by shifting the efficiency changing region in the lifespan register.

18. The method of claim 17, wherein the update signal is generated when a value of a monitoring region in the lifespan register is changed.

19. The method of claim 17, wherein the efficiency changing region is shifted by one bit in response to the update signal.

20. The method of claim 17, wherein the efficiency curve corresponding to the efficiency changing region is loaded from a non-volatile memory device into the LUT in response to the update signal.

21. The method of claim 17, wherein the efficiency curve is scaled in response to the update signal to update the LUT.

22. The method of claim 21, wherein the efficiency curve is scaled to approximately double the efficiency changing period in response to the update signal.

* * * * *